US005664627A

United States Patent [19]

Boyd

[11] Patent Number: 5,664,627

[45] Date of Patent: Sep. 9, 1997

[54] METHOD AND APPARATUS FOR PROTECTING A STEEL RISER FROM CHEMICAL CUTTERS

[75] Inventor: Harper Boyd, Lake Charles, La.

[73] Assignee: Boyd's Bit Service, Inc., Lake Charles, La.

[21] Appl. No.: 607,804

[22] Filed: Feb. 27, 1996

[51] Int. Cl.[6] ..... E21B 29/02

[52] U.S. Cl. ..... 166/298; 166/55; 166/55.1

[58] Field of Search ..... 166/55, 55.1, 297, 166/298, 386

[56] References Cited

U.S. PATENT DOCUMENTS

| | | | |
|---|---|---|---|
| 4,298,063 | 11/1981 | Regalbuto | 166/55 |
| 4,352,397 | 10/1982 | Christopher | 166/55 X |
| 4,446,920 | 5/1984 | Woytek et al. | 166/55 X |
| 4,619,318 | 10/1986 | Terrell et al. | 166/297 X |
| 5,287,920 | 2/1994 | Terrell | 166/55 |
| 5,509,480 | 4/1996 | Terrell et al. | 166/55 X |
| 5,513,570 | 5/1996 | Mulcahy | 166/63 X |

*Primary Examiner*—Roger J. Schoeppel
*Attorney, Agent, or Firm*—Pravel, Hewitt, Kimball & Krieger

[57] ABSTRACT

A sleeve member constructed of material, preferably aluminum metal, nonreactive with chemicals from a chemical cutter, including a ringed collar around its upper end, the ring collar secured to the upper end of the sleeve, and defining a base for hanging the sleeve within a bore of a steel riser positioned in as part of a wellhead assembly, the sleeve having an o.d. slightly smaller than the i.d. of the steel riser, and an internal bore of sufficient interior diameter so as to allow a chemical cutter to be positioned there within, the sleeve being of sufficient length to allow the entire chemical cutter to be positioned therein, while the chemical cutter is positioned within the wellhead assembly. The sleeve would further include a plurality of centralizers at its lower end, for maintaining the sleeve positioned equidistant at all points along its length between itself and the steel riser. There may be further included an additional sleeve positioned flush against the upper end of the first aluminum sleeve so as to provide an extended sleeve within the steel riser, the sleeve serving to receive the impact of an inadvertent firing of the chemical cutter as it is housed within the sleeve, so that the aluminum metal within the sleeve does not react with the chemical compound within the cutter, and therefore would not be eroded away, and would protect the steel riser from the chemical compound of the cutter. Further, there may be included a fluid housed within the wall of the steel riser and the wall of the aluminum sleeve so as to provide further protection between the chemical compound of the cutter when fired and the steel riser wall.

14 Claims, 3 Drawing Sheets

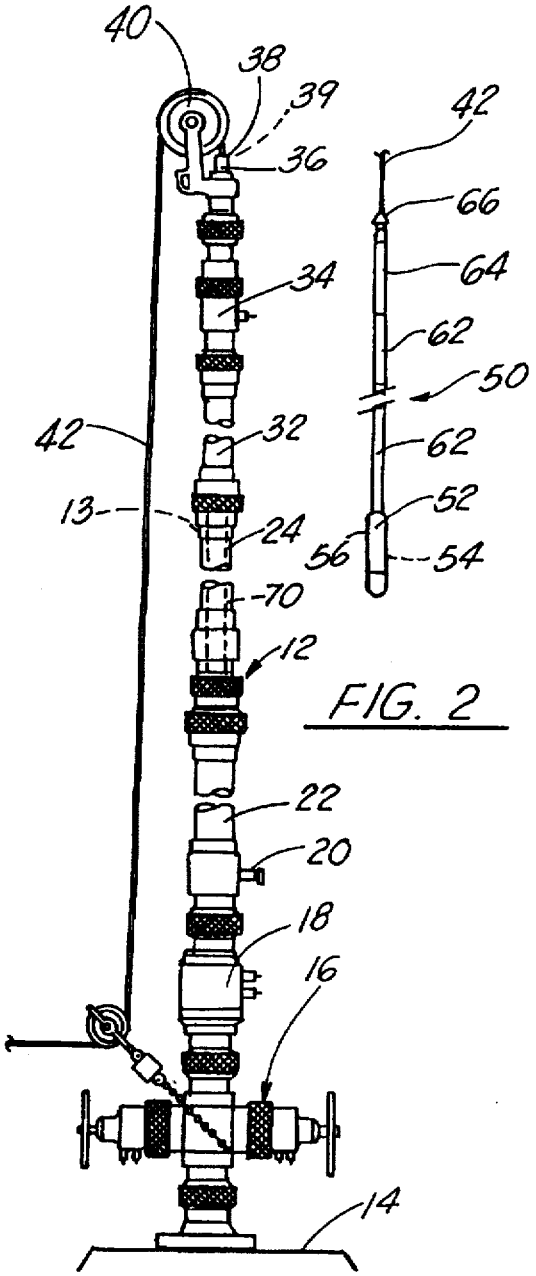
FIG. 2
FIG. 1
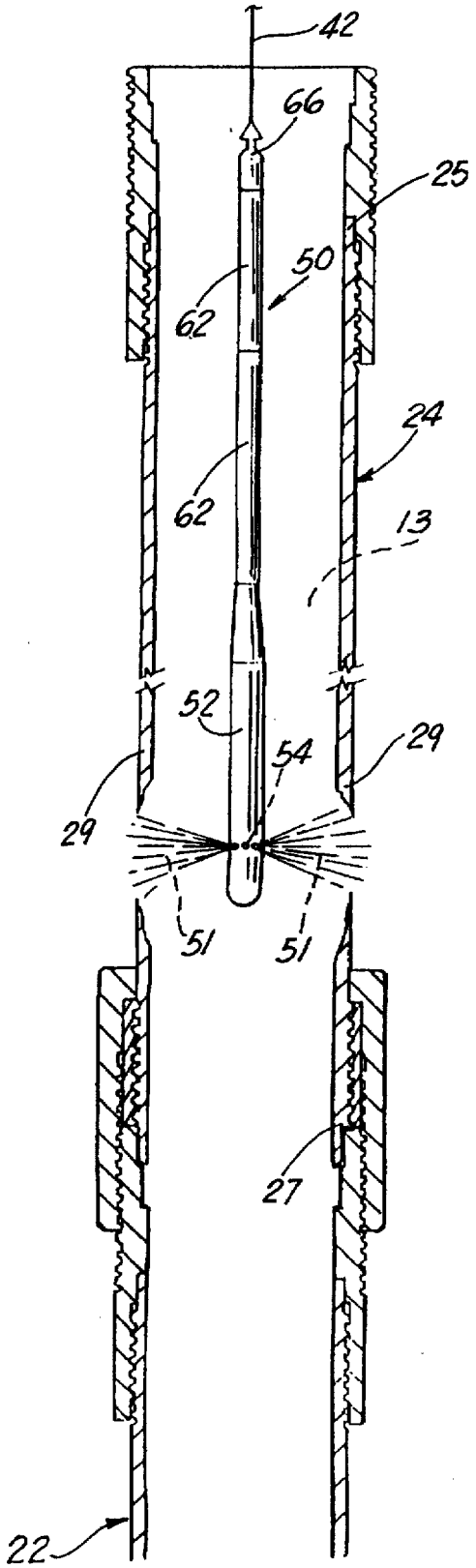
FIG. 3

METHOD AND APPARATUS FOR PROTECTING A STEEL RISER FROM CHEMICAL CUTTERS

BACKGROUND OF THE INVENTION

1. Field of the Invention

The apparatus and method of the present invention relates to chemical cutters. More particularly, the present invention relates to a method for inserting an aluminum sleeve along the body of a metal or steel riser in order to protect the steel riser from cutting or damage should a chemical cutter inadvertently fire while positioned within the wellhead assembly.

2. General Background

During the drilling and production of oil wells, but more particularly during that portion of the drilling activity which involves the recovery of pipe from the borehole, the pipe is usually retrieved in sections out of the borehole. In order to retrieve sections of pipe, the pipe must be spliced or cut while down the borehole, so that the uppermost section can be retrieved from the remainder of the pipe in the well. One such method of cutting the pipe is to utilize a cutting system known as chemical cutters, which are usually a firing mechanism positioned at the end of a wireline, the firing mechanism including a plurality of ports within the lower end of the firing mechanism, so that when the mechanism is fired, a stream of chemical compound is blown from the cutter head, and, in effect, eats or cuts its way through the pipe within the borehole. In most instances, the type of pipe which is utilized is a steel pipe, which is quite reactive with the chemical compound within the cutter, so that upon contact with the steel pipe, the chemicals will cut through the steel, and therefore, enable the section of pipe above the cut to be retrieved.

One of the hazards in utilizing the chemical cutter, is that the cutter mechanism, as was stated earlier, must be hung from the wireline in the well head assembly. The well head assembly is that portion of the drilling rig which extends above the rig floor, upward. Usually, the assembly includes an extended riser, which is a length of steel pipe inner-connecting portions of the well head assembly, for feeding the wireline therethrough. The well head assembly which includes a lubricator can be pressured up to a certain amount of pressure, while the chemical cutter is positioned therein, prior to it being lowered into the well below the rig floor. The wireline would be threaded through an upper spool on the well head assembly, and threaded through a port, with the chemical cutter attached at the end of the wireline for ultimately being lowered downhole.

One of the hazards which is faced at this point, is the chemical cutter which, although may be set to fire downhole because of the pressure or other reasons, may inadvertently fire when it is housed within the riser between the spool and the floor, and would therefore cut through the wall of the steel riser. This, of course, could be catastrophic in that the well head assembly would, in effect, be severed in two, and the upper portion of the assembly would come tumbling down onto the rig floor, which would certainly cause damage and may cause grave injury or even death to workers in and around the well head assembly. This same inadvertent firing may occur after the chemical cutter has been retrieved from downhole, in the event it failed to fire downhole for some unexplained reason. Often times when that occurs and the chemical cutter is retrieved because the well head assembly may be pressurized or the like, again the chemical cutter may inadvertently fire as it is within the wellhead assembly and the same result will occur.

Therefore, there is presented a need in the industry for devising a method and an apparatus which would protect the wellhead assembly and particularly the wall of the steel riser in which the chemical cutters are housed above the rig floor, so that should there by inadvertent firing of the chemical cutter, that the damage to the riser or well head assembly would be avoided, and a new chemical cutter would simply be positioned in place.

SUMMARY OF THE INVENTION

The apparatus and method of the present invention solves the problems in the art in a simple and straight forward manner. What is provided is in a well head assembly which extends from the rig floor upward to a wireline spool at the upper end of the wellhead assembly, would comprise at least a section of steel pipe or riser, extending between two portions of the wellhead assembly; the riser further comprising a continuous steel wall and defining an internal bore therethrough. There would further be provided an aluminum sleeve member including a ringed collar around its upper end, the ring collar secured to the upper end of the aluminum sleeve, and defining a means for hanging the aluminum sleeve within the bore of the steel riser, the aluminum sleeve having an o.d. slightly smaller than the i.d. of the steel riser. The aluminum sleeve would further comprise an internal bore of sufficient interior diameter so as to allow a chemical cutter to be positioned there within, the sleeve being of sufficient length to allow the entire chemical cutter to be positioned therein, prior to lowering the chemical cutter downhole. The aluminum sleeve would further include a plurality of centralizers at its lower end, the centralizers defining a means for maintaining the aluminum sleeve positioned equidistant at all points along its length between itself and the steel riser so that when the chemical cutter is lowered within the bore of the aluminum sleeve, it is centrally positioned therein. There may be further included an additional aluminum sleeve positioned flush against the upper end of the first aluminum sleeve so as to provide an extended sleeve within the steel riser, the aluminum sleeve serving to receive the impact of an inadvertent firing of the chemical cutter as it is housed within the sleeve, so that the aluminum metal within the sleeve being constructed of sufficiently inert material, such as Aluminum metal, so as not to react with the chemical compound within the cutter, and therefore would not be eroded away, and would protect the steel riser from the chemical compound of the cutter. Further, there may be included a fluid housed within the wall of the steel riser and the wall of the aluminum sleeve so as to provide further protection between the chemical compound of the cutter when fired and the steel riser wall.

Therefore, it is the principal object of the present invention to provide a method for protecting a steel riser against the inadvertent firing of a chemical cutter within the riser bore, by positioning an aluminum sleeve within the bore of the riser for receiving the impact of the chemical compound when the chemical cutter fires inadvertently within the riser;

It is a further object of the present invention to provide a metallic sleeve within a steel riser, the metallic sleeve having sufficient aluminum metal within the sleeve make-up so as to not react with any chemical compound which may be fired by a chemical cutter housed within the sleeve and would protect the steel riser from any inadvertent firing;

It is a further object of the present invention to provide a system for protecting a steel riser from the inadvertent firing of a chemical cutter within a well head assembly, by lowering an aluminum metallic sleeve within that portion of the riser housing the chemical cutter, the aluminum sleeve protecting the steel riser from any chemical compound that may be fired from the cutter, due to the fact that the aluminum metal within the sleeve is non-reactive with the compound fired by the chemical cutter.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 illustrates an overall view of the wellhead assembly of the present invention;

FIG. 2 illustrates a view of a chemical cutter of the type utilized with the present invention;

FIG. 3 illustrates chemical cutter lowered within a steel riser and inadvertently firing therein;

DETAILED DESCRIPTION OF THE PREFERRED EMBODIMENT

Figure 4:
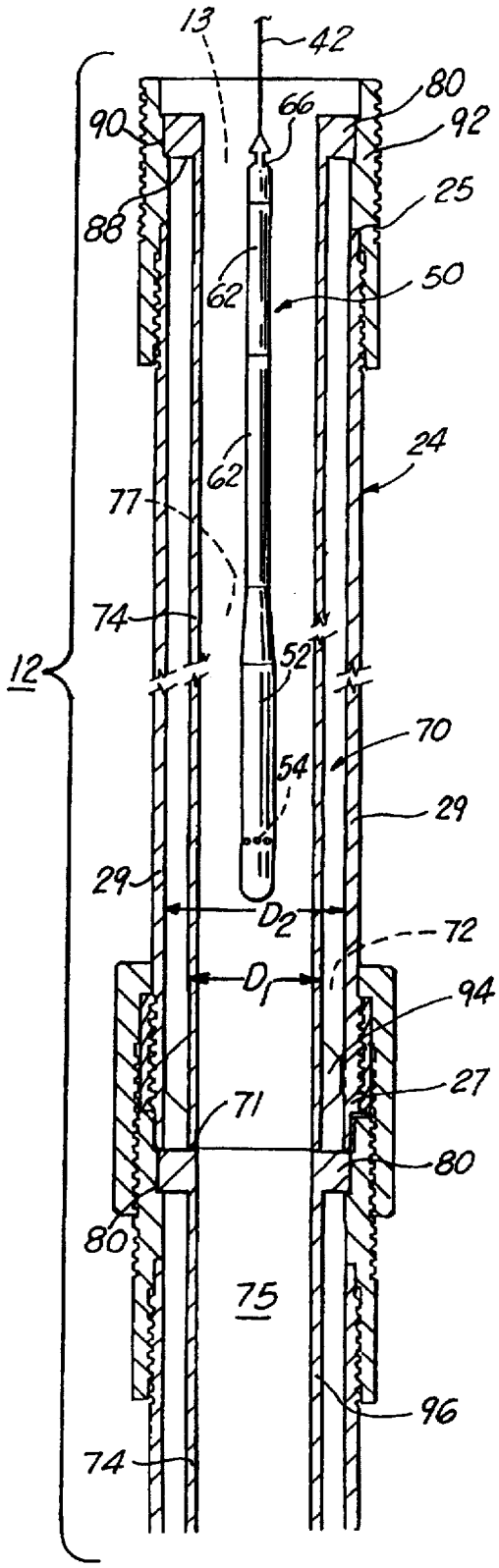
FIG. 4 illustrates a cross-section view of a chemical cutter lowered in within a steel riser protected by the aluminum sleeve used in the present invention.

FIGS. 1-6 illustrate the preferred embodiment of the apparatus utilized in the present invention by the numeral 10. As illustrated in FIG. 1, the well head assembly 12 is illustrated in overall view. What is provided is the rig floor 14 supporting the well head assembly 12, which comprises a plurality of assembly units including a wireline blowout preventer 16, a tool trap 18, a bleed off valve 20, a first lower riser 22, a second upper riser 24, which as seen in phantom view further comprises an aluminum sleeve 70 of the present invention that will be discussed further. Above riser 24, there is further included an upper riser 32; an upper head catcher 34, with the well head assembly 12 terminating at its upper end 36 at an upper rope socket 38, including a spool member 40, from which a wireline 42 extends from a distal point 44 on the rig floor 14. The wireline 42 threads into the bore 39 of rope socket 38, and down into a continuous bore 13 formed by the various elements of the well head assembly 12, so that it may be lowered downhole, as will be discussed further.

The well head assembly 12, as illustrated in FIG. 1, would be of the type that could house a chemical cutter 50, as is illustrated in FIG. 2. The chemical cutter 50, as illustrated, is the type of cutter well known in the art of cutting sections of pipe. The cutter 50 would include the lower cutter body 52, having a plurality of ports 54 along its continuous wall portion 56, so that as the chemical compound is released from the cutter body 52, it would be released outward in a 360 degree direction, as will be more fully explained. The cutter, as illustrated in FIG. 2, further includes sinker bars 62, a collar locator 64, and a rope socket 66, which would serve as the attachment point between the cutter 50 and the wireline 42. Returning to FIG. 1, as seen, the wireline 42 extending into the upper end 36 of the well head assembly 12 would include the chemical cutter 50, as illustrated in FIG. 2, supported therefrom in the wellhead assembly 12.

FIG. 3 illustrates the chemical cutter as utilized in the current state in the art, and the consequences if inadvertent firing in the wellhead 12. As illustrated, chemical cutter 50 is illustrated in a position within riser 24, of the type as was seen in FIG. 1. The chemical cutter 50 is hung from wireline 42, and would be housed within the bore 13 of the steel riser 24, with the steel riser 24 threaded on its upper end 25 and lower end 27 to the members of the assembly above and below it. As illustrated, the chemical cutter 50 would be in a position in normal circumstances to then be lowered down hole for use down hole. However, in FIG. 3 what is seen is the chemical cutter 50 inadvertently firing due to several reasons as explained earlier, and the chemical compound 51 being spewed from the ports 54 within the cutter body 52, making contact with the wall 29 of the steel riser 24, and in effect, cutting through the wall and severing the wall 29 of riser 24 in a 360 degree path. Such a cut into the wall 29 of steel riser 24 by cutter 50 while in the well head assembly 12 could result in catastrophic results, in that the upper portion of the well head assembly 12, above the cut, could fall onto the rig floor 14, injuring or killing workers there below.

Figure 5:
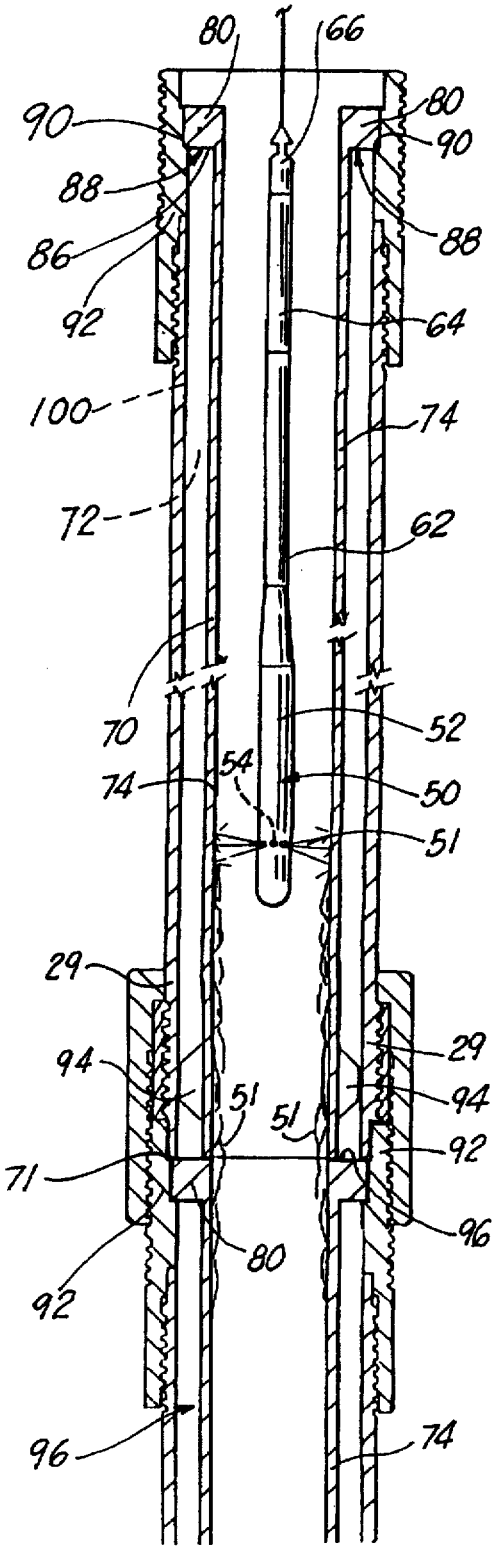
FIG. 5 illustrates cross sectional view of the chemical cutter inadvertently firing within a steel riser containing an aluminum sleeve there within.
Figure 6:
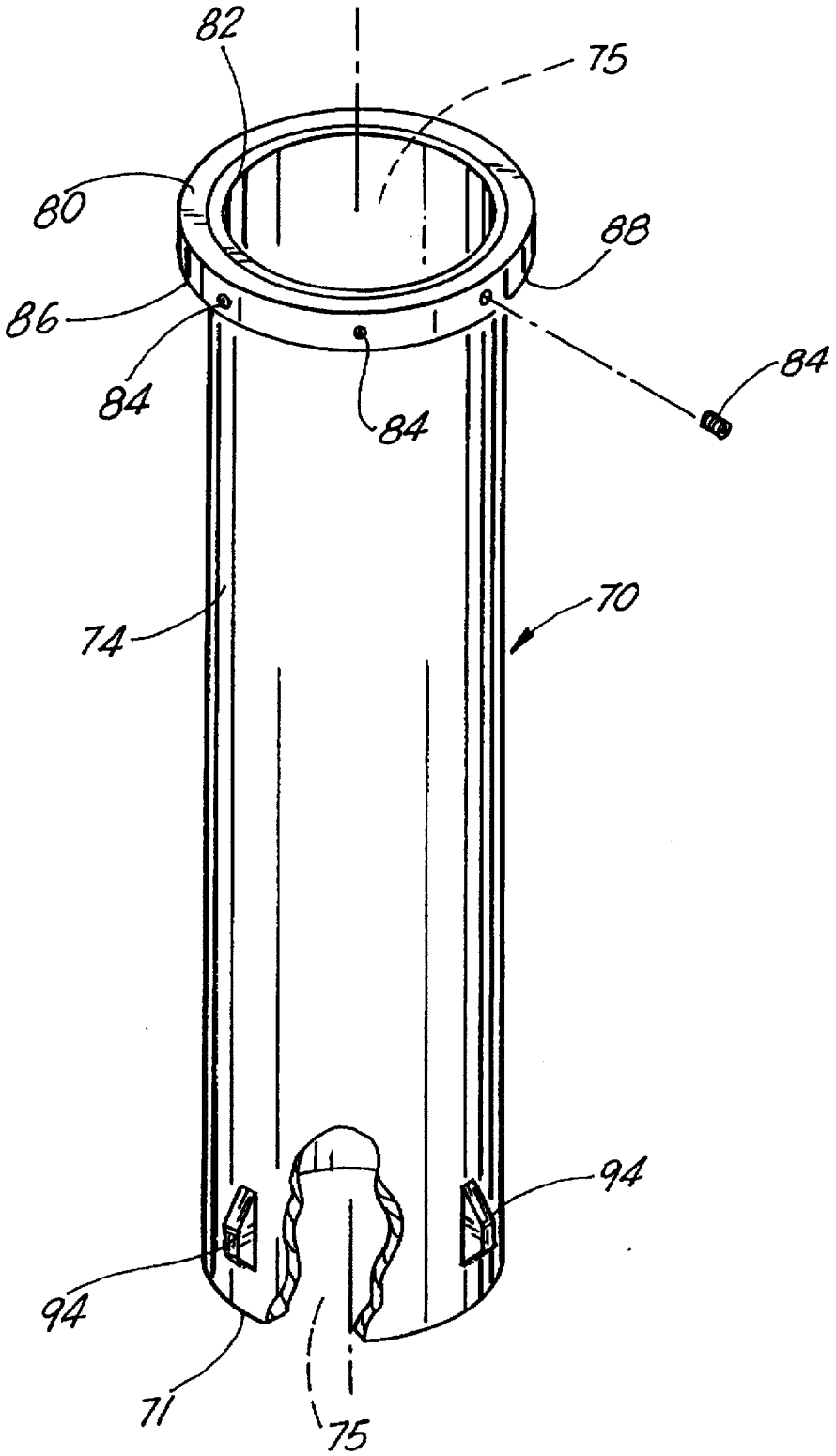
FIG. 6 illustrates an overall view of the aluminum sleeve utilized in the apparatus and method of the present invention.

FIGS. 4, 5 and 6 illustrate the method and apparatus of the present invention which attempts to solve the problems as was discussed and illustrated, particularly in FIG. 3. As seen in FIG. 4, the chemical cutter 50, is again housed within the steel riser 24, and is supported from the wireline 42 ready to be lowered down hole. In this position, usually the well head assembly 12 has been pressured up, and the chemical cutter 50 is set to fire after it has been lowered to a predetermined depth downhole. However, in order to avoid the circumstances that could have occurred as seen in FIG. 3, there is further illustrated a means for preventing the chemical compound 51 which would be fired from the chemical cutter 50 in an inadvertent firing from making contact with the wall 29 of the steel riser 24. This means includes an elongated metal sleeve 70, positioned within the bore 13 of the steel riser, with the outer diameter D1 of the metal sleeve 70 being substantially less than the inner diameter D2 of the steel riser 24, and defining an annular space 72 therebetween.

As illustrated more clearly in FIG. 6, metallic sleeve 70, would include a continuous wall portion 74, defining a continuous bore 75 therethrough. The bore 75 would be of sufficient diameter so as the define an annular space 77 between the cutter 50 lowered within the sleeve 70 and the wall of the cutter 50 (See FIG. 4). The wall portion 74 of sleeve 70 would comprise a sufficient amount of non-reactive metal so as not to react with the chemical compound 51 which would be delivered from cutter 50. In the preferred embodiment, the metal would be aluminum metal, of sufficient quantity in the sleeve 70, so that the aluminum metal contained in the sleeve 70, would be unreactive to any chemical compound 51, that would make contact with the inner surface of sleeve wall 74, should the chemical cutter 50 inadvertently fire as seen in FIG. 4. Because of the nature of aluminum metal, being in effect, inert to the reactiveness with the chemical compound 51 firing from the chemical cutter 50, any chemical compound making contact with the aluminum sleeve 70 would not eat through the wall 74 of the sleeve 70 but would simply be held within the annular space 77 and would therefore, not make contact with the steel riser 24 which is very reactive to the chemicals 51 from cutter 50, as previously described in FIG. 3.

Turning now to the manner in which the sleeve 70 is maintained within the riser, reference is made to FIG. 6. As seen in the figure, there is illustrated sleeve 70, further comprising a circular collar 80, which is positioned on the upper end 82 of the sleeve 70, with a plurality of threaded members 84 through collar 80, so that when tightened, would engage the collar 80 tightly in place around the upper end 82 of sleeve 70 as seen in side view in FIG. 5. The collar 80 would define a shoulder 86, having a lower support surface 88, which would rest on a circular notched portion 90 of an outer connector sleeve 92, as seen in FIG. 5. Therefore, when the support surface 88 of collar 80 is resting on the notched portion 90 of sleeve 92, the aluminum sleeve 70 is positioned centrally within the bore 13 of the steel riser 24, and would be of sufficient length to hang substantially within the entire length of the riser 24. On the lower end 71 of the sleeve 70, there would be further included a plurality of at least three centralizers 94, which are members extending outward from the outer wall 74 of the aluminum sleeve 70, and would make contact with the inner surface of the wall 29 of the steel riser 24, so as to maintain the lower end 71 of the sleeve 70, would likewise be centrally positioned within the bore 13 of the riser 24. As further illustrated in FIG. 5, there may be at least a second sleeve member 96, which would again be hung from a lower second connector sleeve 92, the upper end 98 of the lower sleeve 96 making contact with the lower most end 71 of the upper sleeve wall 25, so that in effect, forming a continuous aluminum protective sleeve between the chemical cutter 50 and the riser 24, as illustrated in FIG. 5.

Further illustrated in FIG. 5, the chemical cutter 50 again has inadvertently fired in the same manner as was seen in FIG. 4. However, what has occurred is that instead of the chemical compound 51 making contact with the wall 25 of the steel riser 24, the compound 51 makes contact with the aluminum sleeve 70, and due to its non-reactiveness, there is no chemical reaction between the aluminum sleeve 70 and the chemical compound 51, and therefore the compound 51 simply does not ever make contact with the steel riser 24 and the riser 24 remains protected.

In the preferred embodiment, as seen in FIG. 5, there may be included a type of fluid which could be water, compound, foam or the like 100, which could be placed within the annular space 72 between the wall of the steel riser 24 and the wall 74 of the aluminum sleeve 70. This fluid layer 100 would again serve as an additional means for maintaining the protection between the wall of the steel riser 24 and the chemical compound 51 that may inadvertently be spewed out of the chemical cutter as illustrated in FIG. 5.

The method of utilizing the present invention of the aluminum sleeve 70 within the steel riser 24 would cover a wireline chemical cutter 50 inadvertently firing during either a test conducted on the firing mechanism of the cutter 50, or while entering or exiting the wellhead assembly 12 above ground level, i.e. above the rig floor 14. The method would include forming a notched portion 90 on an inner surface of a connector sleeve 92 within the wellhead assembly 12, lowering an aluminum metal sleeve 70 within the bore 13 of the steel riser 24, the outer diameter D1 of the aluminum sleeve 70 being substantially less than the inner diameter D2 of the steel riser 24. Next, forming a shoulder 86 on the upper end of the sleeve 70 for allowing the shoulder 86 to rest within the notched portion 92 of the outer collar 80; providing centralizers 94 on the lower end 71 of the aluminum sleeve 70 so that the entire length of the aluminum sleeve 70 is maintained within the center of the bore 13 of the steel riser 24; lowering or raising the chemical cutter 50 within the riser 24 to the point that the chemical compound exit ports 54 are contained within and are shielded from the steel riser 24 by the aluminum sleeve 70, so that any firing of the chemical compound 51 through the ports 54 would only make contact with the wall 74 of the aluminum sleeve 70 and would not make contact with the wall of the steel riser 24.

It should be noted that one could construct an all aluminum riser with a thick wall, which may prevent a chemical cutter from cutting through the riser wall. However, because of the nature of aluminum metal, aluminum metal could not withstand sufficient vertical tension or internal pressure that can be obtained utilizing steel risers. It is foreseen in the preferred embodiment, that it would be possible to construct a steel riser having an internal layer of aluminum metal as its inner wall, which would protect the steel outer wall. However, such a construction may be impermissibly expensive, and could not be utilized on a regular basis.

The following table lists the parts numbers and parts descriptions as used herein and in the drawings attached hereto.

PARTS LIST

| Description | Part Number |
|---|---|
| apparatus | 10 |
| well head assembly | 12 |
| bore | 13 |
| rig floor | 14 |
| blow out preventer | 16 |
| tool trap | 18 |
| bleed off valve | 20 |
| lower riser | 22 |
| upper riser | 24 |
| upper end | 25 |
| lower end | 27 |
| wall | 29 |
| third riser | 32 |
| upper head catcher | 34 |
| upper end | 35 |
| rope socket | 38 |
| bore | 39 |
| spool member | 40 |
| wireline | 42 |
| distal point | 44 |
| chemical cutter | 50 |
| chemical compound | 51 |
| cutter body | 52 |
| ports | 54 |
| wall portion | 56 |
| shear bar | 62 |
| collar locator | 64 |
| rope socket | 66 |
| aluminum sleeve | 70 |
| outer diameter | D1 |
| inner diameter | D2 |
| annular space | 72 |
| wall portion | 74 |
| bore | 75 |
| annular space | 77 |
| circular collar | 80 |
| upper end | 82 |
| threaded members | 84 |
| shoulder | 86 |
| support surface | 88 |
| notched portion | 90 |
| connector sleeve | 92 |
| lower end | 71 |
| centralizers | 94 |
| sleeve member | 96 |
| upper end | 98 |
| fluid layer | 100 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of protecting a steel riser from a chemical cutter comprising the following steps:

a) positioning a steel riser as a part of a wellhead assembly;

b) positioning a sleeve constructed of material nonreactive to chemicals within the chemical cutter, within a bore formed in the riser, the outside diameter of the sleeve being substantially equal or less than the inside diameter of the steel riser;

c) moving the chemical cutter into the wellhead assembly either before or after being downhole; and d) positioning the chemical cutter into the bore of the sleeve so that if the cutter misfires, the chemicals from the cutter will make contact with the non-reactive sleeve and not make contact with the steel riser.

2. The method in claim 1 wherein non-reactive sleeve comprises substantially aluminum metal.

3. The method in claim 1, further comprising centering the lower end of the sleeve with centralizers on its lower end positioned in the annulus between the sleeve and the riser.

4. The method in claim 1, wherein the sleeve is positioned against the inner wall of the riser with a collar member, so that the upper end of the sleeve may fit flush against the lower end of a second length of sleeve positioned there above.

5. The method in claim 1, wherein the wellhead assembly is pressured up with the chemical cutter positioned within the riser.

6. The method in claim 1, wherein the sleeve is substantially the length of the riser in which it is positioned.

7. The method in claim 1, wherein the wellhead assembly is adapted to receive the sleeve in hanging relationship from the upper portion of the riser.

8. An apparatus for protecting a steel riser from a chemical cutter comprising:

a) a steel riser positioned as a part of a wellhead assembly;

b) a sleeve constructed of material nonreactive to chemicals within the chemical cutter, positioned within a bore formed in the riser, the outside diameter of the sleeve being substantially equal or less than the inside diameter of the steel riser;

c) a chemical cutter positioned in the sleeve positioned in the riser so that if the chemical cutter misfires, the chemicals from the cutter will make contact with the nonreactive sleeve and not make contact with the steel riser.

9. The apparatus in claim 8, further comprising a second sleeve provided in a riser, the second sleeve positioned flush against the first sleeve, to provide a continuous protection barrier between the chemical cutter and the riser.

10. The apparatus in claim 8, further comprising a shoulder portion formed on the sleeve for hanging the sleeve from a top portion of the riser, so that the sleeve extends down the bore of the riser.

11. The apparatus in claim 8, further comprising a plurality of centralizers secured to the lower end of the sleeve for centering the sleeve within the bore of the riser.

12. The apparatus in claim 8, wherein the nonreactive sleeve principally comprises aluminum metal.

13. The apparatus in claim 8, wherein the chemical cutter is hung from a wireline in the bore of the sleeve.

14. An apparatus for protecting a steel riser from a chemical cutter comprising:

a) a steel riser positioned as a part of a wellhead assembly;

b) a sleeve constructed of sufficient aluminum metal so as to define material nonreactive to chemicals within the chemical cutter, the sleeve positioned within a bore formed in the riser;

c) a chemical cutter extending from a wireline in the sleeve positioned in the riser so that if the chemical cutter misfires, the chemicals from the cutter will make contact with the non-reactive sleeve and not make contact with the steel riser.

* * * * *